US008733782B2

(12) United States Patent
Smith et al.

(10) Patent No.: US 8,733,782 B2
(45) Date of Patent: May 27, 2014

(54) HINGE MECHANISM, COLLAPSIBLE ASCENSION SKI HAVING SUCH A HINGE MECHANISM, AND RELATED METHODS AND KITS

(75) Inventors: Cory Smith, Ketchum, ID (US); David Narajowski, Los Gatos, CA (US); Bob Carrasca, Seattle, WA (US); David Sanders, Salt Lake City, UT (US)

(73) Assignee: Backcountry Garage, LLC, Ketchum, MD (US)

( * ) Notice: Subject to any disclaimer, the term of this patent is extended or adjusted under 35 U.S.C. 154(b) by 41 days.

(21) Appl. No.: 13/273,902

(22) Filed: Oct. 14, 2011

(65) Prior Publication Data

US 2012/0091693 A1 Apr. 19, 2012

Related U.S. Application Data

(60) Provisional application No. 61/457,185, filed on Jan. 24, 2011, provisional application No. 61/344,814, filed on Oct. 15, 2010.

(51) Int. Cl.

| | |
|---|---|
| ***A63C 5/02*** | (2006.01) |
| ***A63C 7/02*** | (2006.01) |
| ***E05D 11/10*** | (2006.01) |

(52) U.S. Cl.

USPC ..... 280/603; 16/349

(58) Field of Classification Search

USPC ..... 280/603, 604, 614, 617, 618, 634; 16/434, 346, 349, 350, 360

See application file for complete search history.

(56) References Cited

U.S. PATENT DOCUMENTS

| | | | |
|---|---|---|---|
| 1,317,770 | A | 10/1919 | Winter |
| 2,260,057 | A | 5/1939 | Rydberg |
| 2,241,992 | A | 5/1941 | Hall |

(Continued)

FOREIGN PATENT DOCUMENTS

| | | | |
|---|---|---|---|
| AT | 407 610 | B | 5/2001 |
| DE | 3303093 | A1 | 8/1984 |

(Continued)

OTHER PUBLICATIONS

"ZigZag Backcountry Material," publication date unknown, [online], [retrieved on Oct. 5, 2011], Retrieved using Internet from <http://www.zigzagtour.de/index0.html>.

(Continued)

*Primary Examiner* — Frank Vanaman

(74) *Attorney, Agent, or Firm* — Venable LLP; Steven J. Schwarz

(57) ABSTRACT

A hinge mechanism includes a first hinge element, a second hinge element, and a locking element. The first and second hinge elements each include a plate portion and a plurality of substantially parallel fingers spaced from one another. The pluralities of substantially parallel fingers interlock with one another along a pivot axis such that the first and second hinge elements are rotatable relative to one another about the pivot axis between an extended position and a folded position. The locking element extends substantially parallel to the pivot axis and may be configured to releasably engage a receiving portion in one of the pluralities of substantially parallel fingers when the first and second hinge elements are in the extended position to lock the first and second hinge elements relative to one another. A collapsible ascension ski having such a hinge mechanism as well as related methods and kits are also disclosed.

31 Claims, 14 Drawing Sheets

(56) References Cited

U.S. PATENT DOCUMENTS

| | | | | | |
|---|---|---|---|---|---|
| 2,332,404 | A | | 11/1941 | Smith | |
| 2,367,528 | A | | 9/1943 | Rollins | |
| 2,791,435 | A | | 5/1957 | Meland | |
| 3,104,888 | A | | 9/1963 | Day et al. | |
| 3,596,918 | A | | 8/1971 | Masuda | |
| 3,689,093 | A | | 9/1972 | Meland | |
| 3,744,811 | A | | 7/1973 | Johnston | |
| 4,125,273 | A | | 11/1978 | Rothmayer | |
| 4,141,570 | A | * | 2/1979 | Sudmeier | 280/607 |
| 4,155,568 | A | | 5/1979 | Galich | |
| 4,248,449 | A | | 2/1981 | Wilhelmy | |
| 4,358,130 | A | | 11/1982 | Adams | |
| 4,358,131 | A | * | 11/1982 | Schwartz | 280/614 |
| 4,405,150 | A | | 9/1983 | Esper | |
| 4,530,511 | A | | 7/1985 | Brandt, III | |
| 4,593,926 | A | | 6/1986 | Pergola | |
| 4,632,418 | A | | 12/1986 | Brue Moya et al. | |
| 4,635,955 | A | * | 1/1987 | Zoor | 280/614 |
| 4,723,789 | A | | 2/1988 | Schmidt | |
| 4,780,929 | A | | 11/1988 | Burns et al. | |
| 4,844,499 | A | | 7/1989 | Baumann | |
| 5,044,044 | A | | 9/1991 | Young et al. | |
| 5,261,689 | A | * | 11/1993 | Carpenter et al. | 280/618 |
| 5,884,933 | A | | 3/1999 | Trott | |
| 5,984,324 | A | | 11/1999 | Wariakois | |
| 6,616,170 | B1 | | 9/2003 | Quarti | |
| 6,926,301 | B2 | | 8/2005 | Emanuele et al. | |
| 7,178,199 | B2 | | 2/2007 | Kashiwaguma | |
| 7,575,138 | B2 | | 8/2009 | Lindberg | |
| 7,681,904 | B2 | | 3/2010 | Ekberg | |
| 2004/0021297 | A1 | | 2/2004 | Ekberg et al. | |
| 2005/0046149 | A1 | | 3/2005 | Ekberg | |
| 2005/0167947 | A1 | | 8/2005 | Ekberg | |
| 2008/0174089 | A1 | | 7/2008 | Ekberg | |
| 2008/0184599 | A1 | | 8/2008 | Ekberg | |
| 2008/0185817 | A1 | | 8/2008 | Gyr | |
| 2009/0256332 | A1 | | 10/2009 | Ekberg | |
| 2010/0219614 | A1 | | 9/2010 | Ekberg | |

FOREIGN PATENT DOCUMENTS

| | | | |
|---|---|---|---|
| DE | 1 00 00 581 | A1 | 8/2001 |
| WO | WO-2005/021112 | A2 | 3/2005 |
| WO | WO-2005/074518 | A2 | 8/2005 |
| WO | WO-2007/044846 | A2 | 4/2007 |
| WO | WO-2007/058719 | A2 | 5/2007 |
| WO | WO-2007/127969 | A2 | 11/2007 |
| WO | WO-2008/089486 | A2 | 7/2008 |
| WO | WO-2008/112936 | A1 | 9/2008 |
| WO | WO-2009/067716 | A1 | 5/2009 |

OTHER PUBLICATIONS

"Climb Ascent System," publication date unknown, [online], [retrieved on Oct. 5, 2011], Retrieved using Internet from <http://www.climb.co.at/en0101.php>.

* cited by examiner

HINGE MECHANISM, COLLAPSIBLE ASCENSION SKI HAVING SUCH A HINGE MECHANISM, AND RELATED METHODS AND KITS

CROSS REFERENCE TO RELATED APPLICATIONS

This application claims the priority benefit under 35 U.S.C. §119(e) of U.S. Provisional Application No. 61/344,814, filed Oct. 15, 2010, and U.S. Provisional Application No. 61/457,185, filed Jan. 24, 2011. Each of the foregoing applications is hereby incorporated by reference in its entirety.

BACKGROUND

1. Field of Invention

The invention relates generally to a hinge mechanism, and more particularly, to a collapsible ascension ski having such a hinge mechanism, the ski being useful for uphill and/or cross-country travel, for example, over unpacked or partially-packed snow in the backcountry. The invention also concerns related methods and kits.

2. Related Art

Skiing and snowboarding are popular winter activities. While most winter sports enthusiasts participate in such activities within the bounds of privately-operated, lift-accessible mountain resorts, many avid skiers and snowboarders also seek access to so-called backcountry terrain. In order to access such terrain without the use of motorized vehicles such as, for example, snow machines, snow cats, and/or helicopters, specialized equipment is typically required in order to enable a skier or snowboarder to traverse cross-country and/or uphill over unpacked, partially packed, or packed snow to a point of descent.

For skiers, accessing and ascending backcountry terrain can often be achieved by slight modifications to the same equipment used for descending. For example, by utilizing specialized bindings with detachable heel pieces and a pair of detachable skins, an alpine skier can easily traverse and ascend over unpacked snow. At the point of descent, the skier can simply remove the skins, lock the heel portion of each binding, and descend. Telemark skiers may similarly attach skins to the bottom of their skis, ascend to a desired location, remove the skins, and descend.

Snowboarders, on the other hand, typically require additional and/or highly modified equipment to access such terrain without significantly increasing the amount and weight of equipment required. For example, snowboarders have been known to utilize split snowboards, various types of modern snowshoes, or so-called "short skis" to traverse and ascend in the backcountry. These solutions, however, have disadvantages. A split snowboard, for example, is essentially a snowboard constructed in two pieces and separable along the longitudinal axis thereof into two distinct "skis" separately attachable to the user's respective boots for ascending and traversing. To descend, the distinct pieces are then coupled together by the user along mating longitudinal edges with known locking/latching mechanisms to form a snowboard. Accordingly, while allowing for both ascending and descending, split boards do not have the same stability and feel as a modern (one-piece) freestyle snowboard when ridden downhill due to the inherent center seam and the resulting play introduced by the large number of locking/mating parts. Moreover, split boards are typically heavy and cumbersome and provide compromised feel and long transition time. Additionally, they can be relatively expensive. Snowshoes also have disadvantages in that they make travel comparably inefficient and slow and do not allow the backcountry snowboarder to take advantage of tracking along packed ski tracks created by, for example, skiers. Likewise, short skis with releasable bindings and removable skins are still similarly inefficient and ineffective as they are both too long to fit in a backpack and not long enough for climbing and traversing through and over unpacked terrain.

What is needed is an effective, lightweight backcountry access tool for snowboarders and/or other outdoor enthusiasts or military that is easily stowable (such as in a backpack) and thereby avoids the foregoing disadvantages. Additionally, a hinge mechanism and/or binding suitable for this and other applications is needed.

SUMMARY

In accordance with an embodiment of the invention, a hinge mechanism is provided. The hinge mechanism may include a first hinge element, a second hinge element, and a locking element. The first hinge element may include a first plate portion and a first plurality of substantially parallel fingers spaced from one another. The second hinge element may include a second plate portion and a second plurality of substantially parallel fingers spaced from one another. The first and second pluralities of substantially parallel fingers interlock with one another along a pivot axis and the first and second hinge elements are rotatable relative to one another about the pivot axis between an extended position and a folded position. The locking element may extend substantially parallel to the pivot axis and may be configured to releasably engage a receiving portion in at least one of the first and second pluralities of substantially parallel fingers when the first and second hinge elements are in the extended position to lock the first and second hinge elements relative to one another.

In accordance with another embodiment of the invention, a collapsible ascension ski device is provided. The collapsible ski device may include a first forward ski member having a tip and a rear end, a second middle ski member having a forward end and a rear end, and a third rear ski member having a forward end and a tail. The forward and rear ends of the second middle ski member may be pivotably coupled to the rear end of the first forward ski member and to the forward end of the third rear ski member, respectively, by the hinge mechanisms. The collapsible ascension ski device may allow a user to traverse uphill or cross-country over unpacked, partially-packed or packed snow on a pair of the skis in the extended position and then collapse each of the skis in two places to a folded position for storage in, for example, a backpack.

In accordance with another embodiment of the invention, the collapsible ascension ski may include a boot binding device. The boot binding may include a support plate pivotably coupled to a top surface of the second middle ski member at a forward end thereof. A toe strap may be coupled to the support plate and configured to be secured over a toe portion of a user's boot. A heel loop may be pivotably coupled to a rear end of the support plate. An ankle strap may be coupled to the heel loop and configured to be secured over an ankle portion of the user's boot. One or both of the heel loop and the toe strap may be longitudinally adjustable along the support plate.

In accordance with yet another embodiment of the invention, a kit for accessing and ascending snow-covered backcountry terrain may be provided. The kit may include a pair of the collapsible ski devices, each ski device including two of the hinge mechanisms and a boot binding device. The kit may further include a backpack configured to receive and stow the ski devices when the ski devices are in a collapsed configuration.

In accordance with yet another embodiment of the invention, a method for making a collapsible ski device is provided. The method includes providing a first forward ski member, a second middle ski member, and a third rear ski member; permanently attaching a strip of climbing skin material to a bottom surface of each of the ski members; pivotably coupling an end of the first forward ski member to an end of the second middle ski member by a first hinge mechanism; pivotably coupling another end of the second middle ski member to an end of the third rear ski member by a second hinge mechanism; and pivotably attaching a boot binding device to a top surface of the second middle ski member.

Further features and advantages, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of some embodiments of the invention, as illustrated in the accompanying drawings. Unless otherwise indicated, the accompanying drawing figures are not to scale. Several embodiments of the invention will be described with respect to the following drawings, in which like reference numerals represent like features throughout the figures, and in which.

DETAILED DESCRIPTION

Some embodiments of the invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the invention. All references cited herein are incorporated by reference as if each had been individually incorporated.

Figure 1:
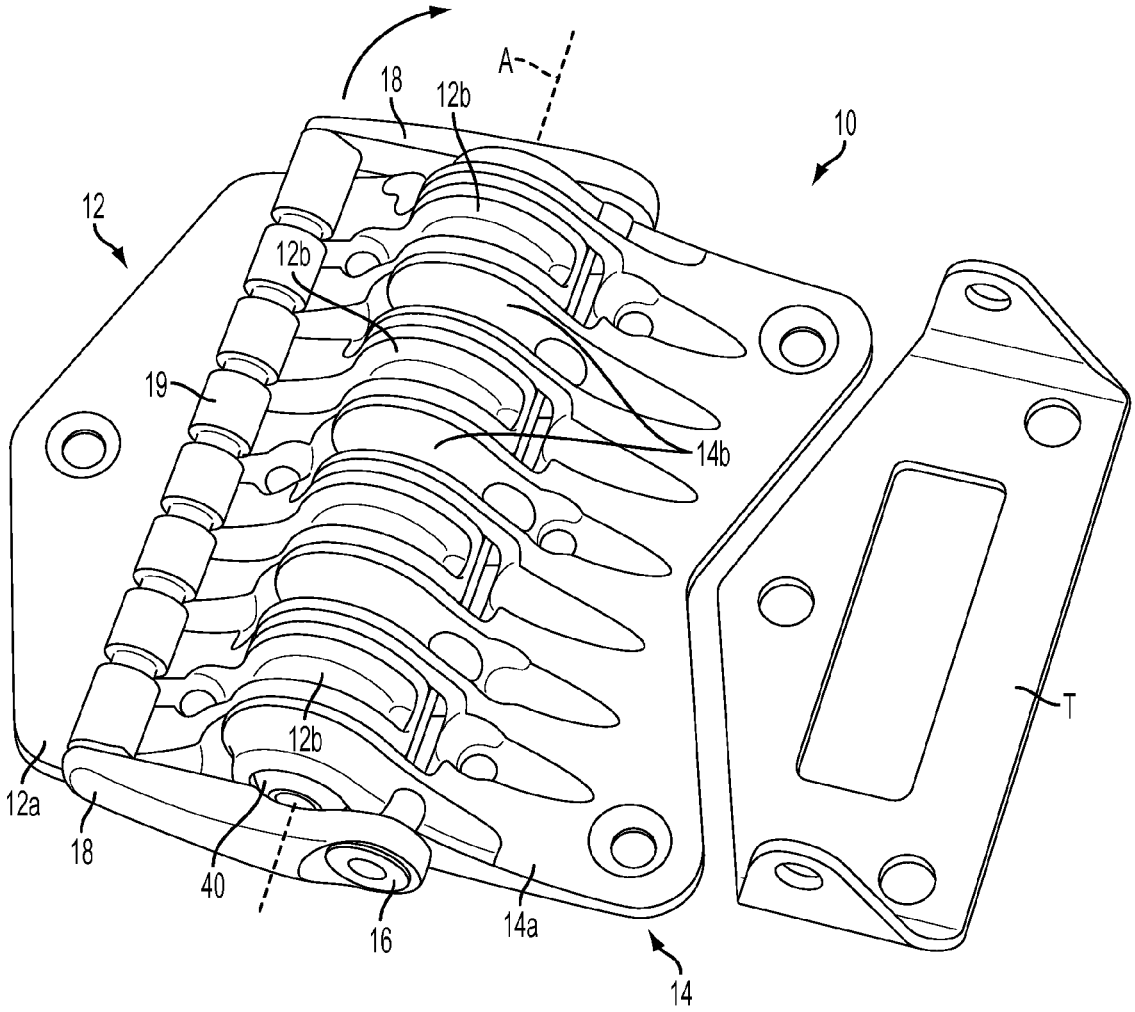
FIG. 1 is a top perspective view of a hinge mechanism in an open or extended and locked position according to an embodiment of the invention.
Figure 2:
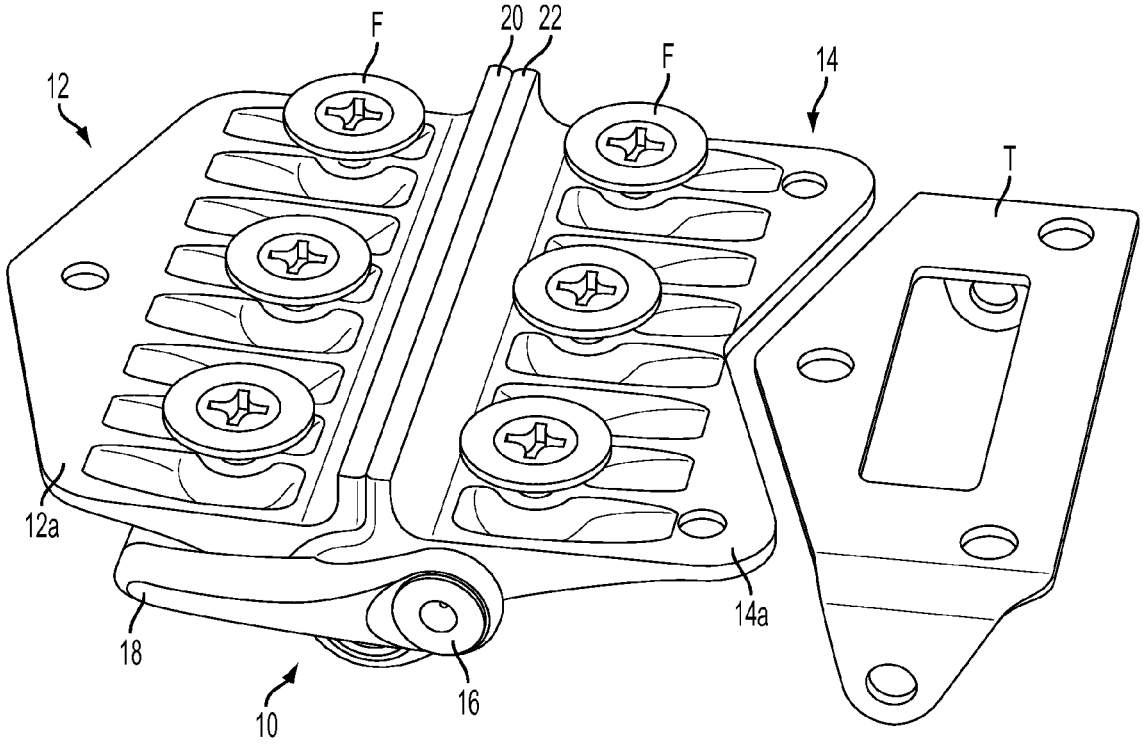
FIG. 2 is a bottom perspective view of the hinge mechanism of FIG. 1.

FIGS. 1 and 2 depict top and bottom perspective views, respectively, of a hinge mechanism 10 in an open or extended and locked position according to an embodiment of the invention. The hinge mechanism 10 may include a first hinge element 12, a second hinge element 14, and a locking element 16. The first hinge element 12 may include a first plate portion 12*a*. The first hinge element 12 may include a first plurality of substantially parallel fingers 12*b* spaced from one another. The second hinge element 14 may include a second plate portion 14*a*. The second hinge element 14 may include a second plurality of substantially parallel fingers 14*b* spaced from one another. The first and second pluralities of substantially parallel fingers 12*b*, 14*b* may be arranged and configured to interlock with one another along a pivot axis A such that the first and second hinge elements 12, 14 are rotatable relative to one another about the pivot axis A between an open or extended position (see FIGS. 1-4) and a folded position (see FIG. 7). A bolt 40 may be provided which extends along pivot axis A through the fingers 12*b*, 14*b* to secure the hinge elements 12, 14 together.

The locking element 16 may extend substantially parallel to the pivot axis A within, for example, a though hole in one of the first or second hinge elements 12, 14. The locking element 16 may be configured to rotatably and releasably engage a receiving portion in the other of the first and second pluralities of substantially parallel fingers 12*b*, 14*b* when the first and second hinge elements 12, 14 are in the extended position to lock the first and second hinge elements 12, 14 relative to one another. An arm 18 may be coupled to at least one end of the locking element 16 to allow a user to rotatably actuate the locking element 16 between a locked position (FIGS. 1-4) and an unlocked position (FIG. 7) and vice versa so that the hinge elements 12, 14 can be respectively locked or pivoted relative to one another. A handle 19 may extend between arms 18 provided at each end of the locking element 16 to allow a user to more easily grip and manipulate the locking element 16.

One or both of the first and second hinge elements 12, 14 may be formed from any suitable strong and durable yet lightweight material such as, for example but not limited to, fiberglass-reinforced injection-molded nylon or the like. Portions of the fingers 12*b*, 14*b* and/or plate portions 12*a*, 14*a* may be contoured or removed for aesthetic appeal and/or light weighting of the hinge mechanism 10 while maintaining strength and durability.

Figure 3:
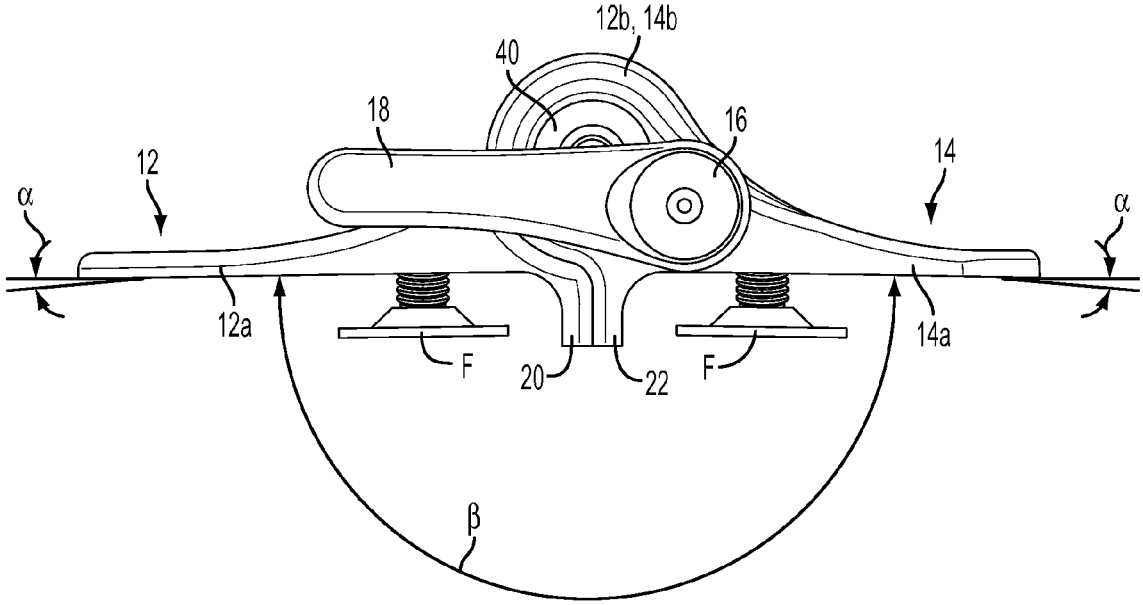
FIG. 3 is a side view of the hinge mechanism of FIGS. 1 and 2 depicting a faceted camber achievable by the hinge mechanism in the extended and locked position according to an embodiment.

FIGS. 1 and 2 also depict a mounting plate T which may be provided proximate hinge mechanism 10 for pivotably mounting a boot binding device when the hinge mechanism 10 is utilized in conjunction with a collapsible ski, as discussed in further detail below. As shown in FIG. 2, the first and second plate portions 12*a*, 14*a* may be configured to receive fasteners F in one or more holes provided therein for securing the plate portions 12*a*, 14*a* to respective pieces of a hinged or foldable device such as, for example but not limited to, adjacent ski members of a collapsible ski, embodiments of which are discussed further below (see FIG. 7). The first and second hinge elements 12, 14 may include respective stop members 20, 22 configured to contact one another when the first and second hinge elements 12, 14 are in the extended position. The stop elements 20, 22 may include first and second plates arranged substantially perpendicular to the first and second plate portions 12*a*, 14*a*, respectively. The stop elements 20, 22 positively engage one another under pressure when the hinge mechanism 10 is in the extended and locked position so as to substantially eliminate play between the hinge elements 12, 14 and, if applicable, between adjacent ski members. FIG. 3 is a side view of the hinge mechanism 10 of FIGS. 1 and 2. When the first and second hinge elements 12, 14 are locked in the extended position as shown, respective surfaces of the first and second plate portions 20, 22 may define a faceted camber. For example, an angle β between the bottom surfaces of the first and second plate portions 12*a*, 14*a* may be less than 180 degrees (e.g., the bottom surface of each plate portion may be approximately 1° below a horizontal reference plane). Alternatively, or concurrently, in an embodiment wherein the hinge mechanism 10 is utilized in a collapsible ski, the angle β may be defined between bottom surfaces of ski members coupled to the first and second plate portions 12*a*, 14*a*, respectively, and may similarly be less than 180 degrees to define a faceted camber.

Figure 4:
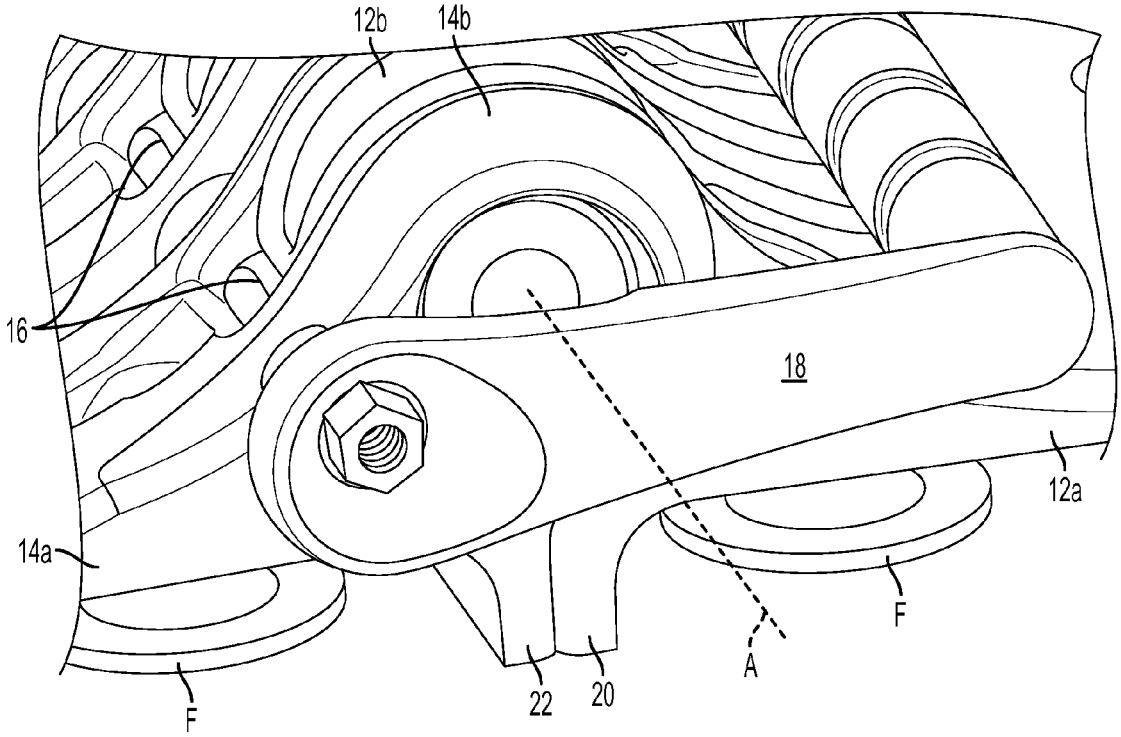
FIG. 4 is an opposite side perspective view of the hinge mechanism of FIGS. 1-3 in the extended and locked position.

FIG. 4 is a detailed and enlarged partial side perspective view of an end of the hinge mechanism 10 of FIGS. 1-3. As shown in FIG. 4, when the first and second hinge elements 12, 14 are in the open and extended position and the locking element 16 is engaged in a receiving portion (e.g., a recess) of, for example, the first plurality of substantially parallel fingers 12*b*, the locking element 16 may be loaded in shear in a plurality of cross-sections by surfaces of the receiving portion in fingers 12*b*. Although not shown in FIGS. 1-4, a safety lock element may be provided having a first part disposed on one of the first and second plate portions 12*a*, 14*a* and a second part on the arm 18 or handle 19. The first and second parts (not shown) may cooperate to prevent the unintentional release of the locking element 16 when in the locked position. In an embodiment (not shown), one of the first and second parts of the safety lock element may include a compliant tab or hook and the other of the first and second parts of the safety lock element may include a mating recess or pocket configured to receive and releasably hold the tab or hook, for example by snap-fit or friction-fit. Additionally, a biasing mechanism (not shown) may be coupled to the locking element 16 and configured to automatically engage the locking element 16 in the receiving portion in fingers 12*b* when the when the first and second hinge elements 12, 14 are approximately in the open and extended position. The biasing mechanism could include, for example, a torsion spring or an elastomeric element configured to bias the locking element 16 into engagement in the receiving portion in fingers 12*b*.

Figure 5:
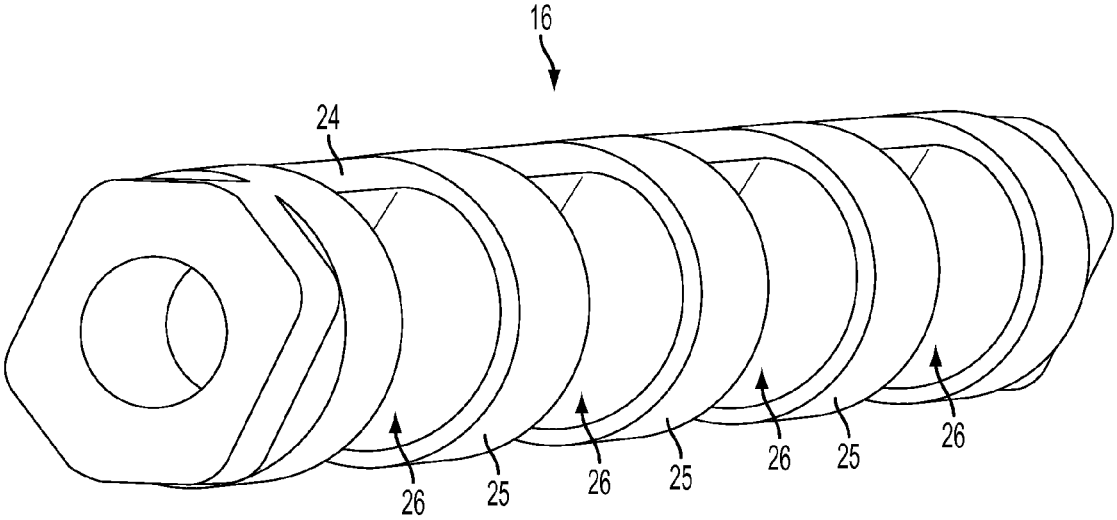
FIG. 5 is a side perspective view of a locking element of the hinge mechanism of FIGS. 1-4 according to an embodiment of the invention.

FIG. 5 is a side perspective view of the locking element 16 of the hinge mechanism 10 of FIGS. 1-4 according to an embodiment of the invention. As shown in FIG. 5, the locking element 16 may be a substantially cylindrical rod including a cam surface 24 configured to engage the receiving portion (recess) in each finger 12*b* of the first plurality of substantially parallel fingers 12*b* and positively lock the first and second hinge elements 12, 14 relative to one another in the extended position when the locking element 16 is rotated to a locked position. The cam surface 24 of the locking element 16 may be defined on only a portion of the locking element 16, the remainder of the locking element 16 having alternating guide surfaces 25 and gaps 26 configured to allow passage of the fingers 12*b* as the hinge elements 12, 14 are pivoted relative to one another when the locking element 16 is rotated to the unlocked position. The locking element 16 may be made of any suitable strong and lightweight material such as, for example but not limited to, die-cast 7075-T6, 6061-T6, or 2024-T6 hardened aluminum, anodized for added strength. One or more of the cam surface 24, guide surfaces 25, receiving portion surfaces (in the first fingers 12*b*) and/or support surfaces (e.g., defined by a through hole in the second hinge element 14 through which the locking element 16 extends) may be ramped or eccentric to provide positive locking upon rotation of the locking element 16 to the locked position.

Figure 6:
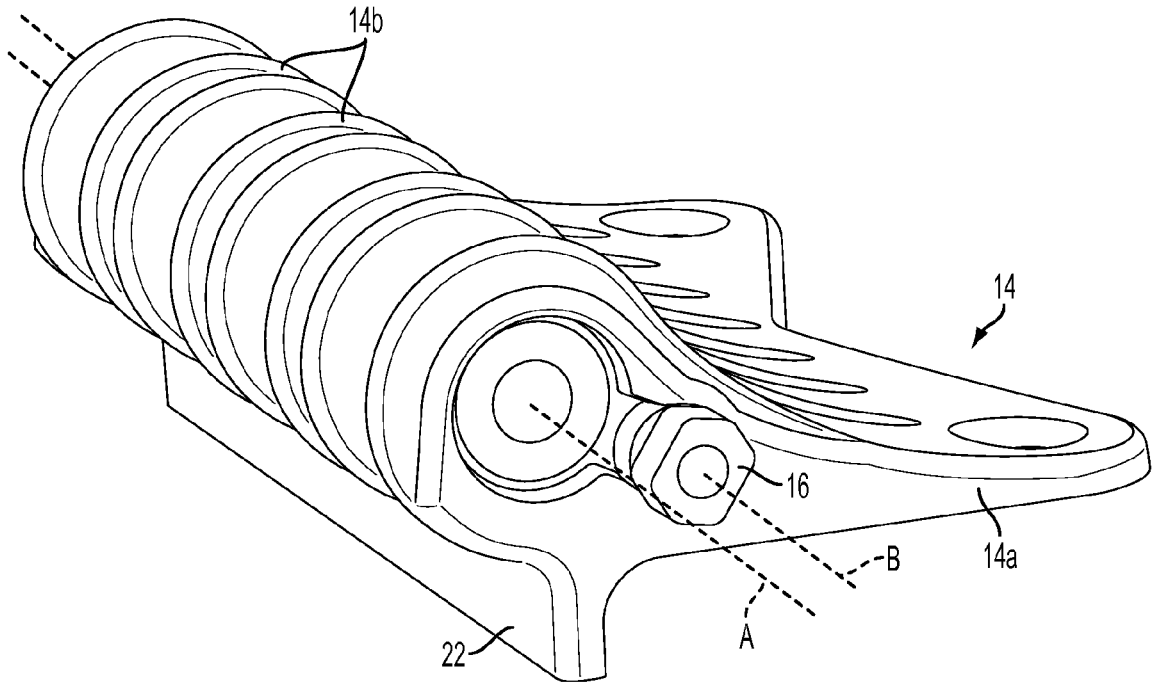
FIG. 6 is a side perspective view of the locking element of FIG. 5 received within and extending through a second hinge element of the hinge mechanism of FIGS. 1-4 according to an embodiment of the invention.

FIG. 6 is a side perspective view of the locking element 16 of FIG. 5 shown as being received within a through hole in the second hinge element 14 of the hinge mechanism 10 of FIGS. 1-4 according to an embodiment of the invention. A longitudinal axis B of the locking element 16 substantially coincides with an axis of the through hole in second hinge element 14 and also extends substantially parallel to the pivot axis A defined along fingers 14*b* of the second hinge element 14. Stop member 22 of the second hinge element 14 is also shown extending downward and away from fingers 14*b*.

Figure 7:
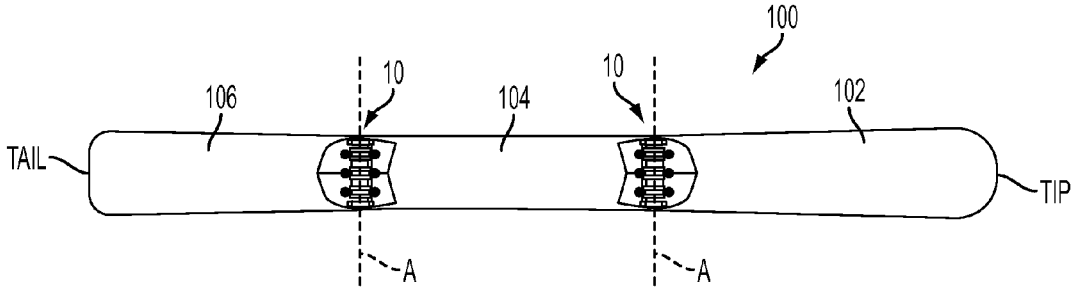
FIG. 7 is a top view of a collapsible ascension ski including two of the hinge mechanisms of FIGS. 1-6 in an extended and locked configuration according to an embodiment of the invention.
Figure 7A:
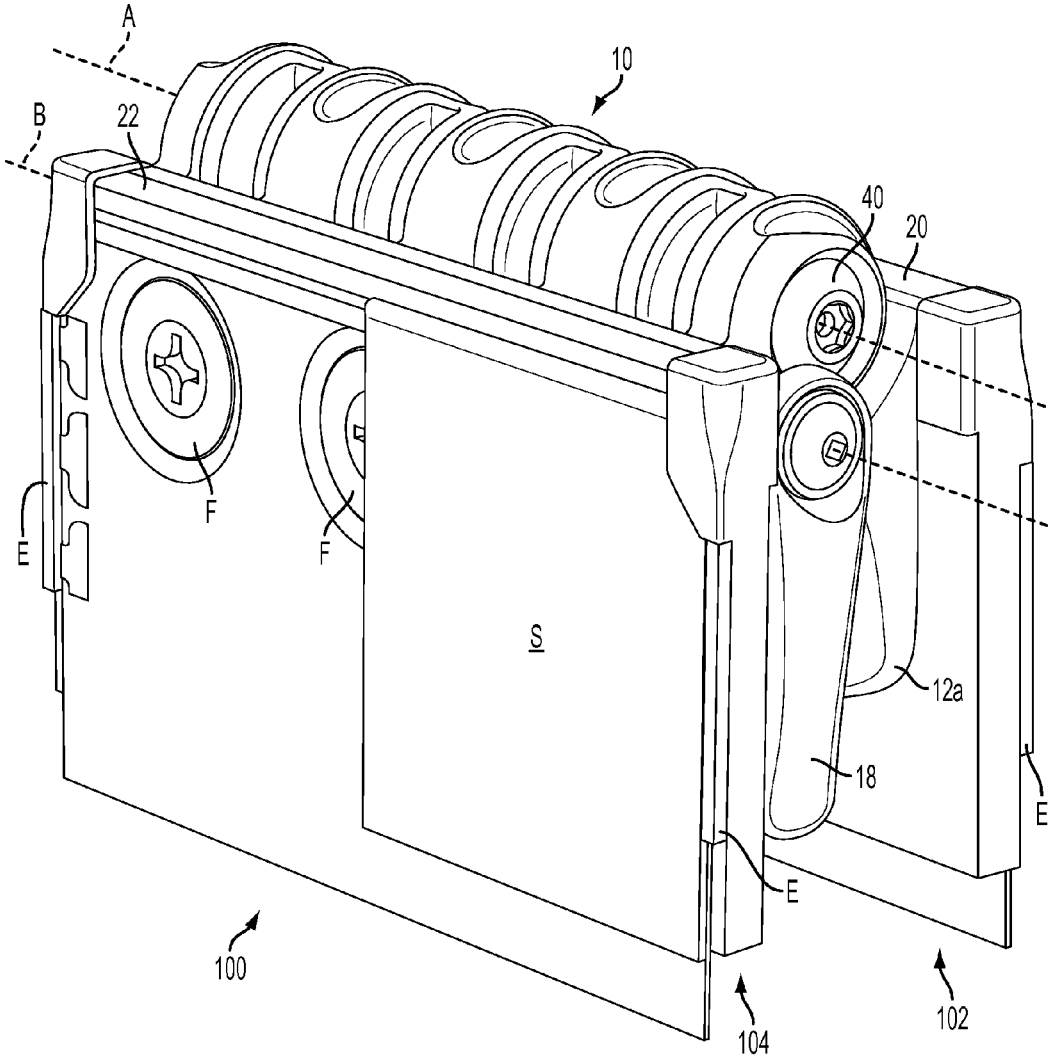
FIG. 7A is a partial perspective view of the collapsible ski of FIG. 7, including the hinge mechanism of FIGS. 1-6, in a folded configuration according to an embodiment of the invention.

FIG. 7 schematically depicts a top view of a collapsible ascension ski 100 in an extended and locked configuration and including two hinge mechanisms 10 according to an embodiment of the invention. The boot binding device, discussed in further below, is omitted in FIG. 7 for simplicity. FIG. 7A is a partial perspective view of a hinged joint of the collapsible ski 100, including the hinge mechanism 10 of FIGS. 1-6, and shown in a folded configuration according to an embodiment of the invention. The collapsible ski device 100 may include a first forward ski member 102 having a tip and a rear end, a second middle ski member 104 having a forward end and a rear end, and a third rear ski member 106 having a forward end and a tail. The ski members 102, 104, 106 may be constructed from any suitable material commonly used to build recreational skis such as, for example but not limited to, a Poplar/Paulownia wood blend core with a full wrap edge E (see FIG. 7A) and ABS cap construction. The cap (top sheet and sidewalls) could also be, for example, wood or stainless steel. The core material may also be, for example, another suitable type of wood, a wood blend, Kevlar®, carbon, fiberglass, epoxy, rubber, a metal (e.g., stainless steel, aluminum, magnesium, or titanium), or a combination. Light weight construction may enable the ski 100 to perform much like a traditional alpine touring (AT) ski. The ski 100 may also have camber and side cut on both edges E to aid in side-hill control during use.

As shown in FIG. 7, the forward and rear ends of the second middle ski member 104 are pivotably coupled to the rear end of the first forward ski member 102 and to the forward end of the third rear ski member 106, respectively, by hinge mechanisms 10 as described above to define hinged joints. The ski device 100 is configured to be collapsed from a locked and extended position (FIG. 7), in which ski members 102, 104, 106 are arranged end-to-end, to a folded position (see FIG. 7A) in which ski members 102, 104, 106 are folded one over the other at the hinged joints so that the ski device 100 can be stowed in or on a user's backpack. For example, in the folded position, the third rear ski member 106 may initially be folded over the second middle ski member 104. The first forward ski member 102 may then be folded over the third rear ski member 106 such that all three ski members 102, 104, 106 are stacked or superposed over one another to define a stack height. The pivot axis A of each of the hinge mechanisms 10 may be substantially parallel to a width of the ski members 102, 104, 106. As described above with reference to FIGS. 2-4, when the ski members 102, 104, 106 are in the extended and locked position, stop members 20, 22 of the respective first and second hinge elements 12, 14 contact one another. Bottom surfaces of the adjacent ski members 102, 104, 106, which may include permanently attached climbing skin material S, may define a faceted camber as described above with regard to FIG. 3. For example, an angle between the bottom surfaces of adjacent ski members 102, 104, 106 may be less than 180 degrees when extended. The first and second plate portions 12*a*, 14*a* of the first and second hinge elements 12, 14 may be secured, for example by fasteners, to a top surface of adjacent ski members 102, 104, 106 or within a core of adjacent ski members 102, 104, 106. To the extent that portions of the hinge mechanism 10 can be received in or share space with the core of the adjacent ski members 102, 104, 106, the folded height, or stack height, of the ski device 100 can be reduced.

As partially shown in the embodiment depicted in FIG. 7A, climbing skin material S in the form of a strip may be secured, permanently or removably, to the bottom surface of each of the first forward ski member 102, the second middle ski member 104, and the third rear ski member 106. For example, according to the embodiment depicted in FIG. 7A, ends of the climbing skin material S may be wrapped up and around the ends of the ski members 102, 104, 106 arranged proximate the hinged joint and secured in place against a surface of the ski member by a portion of the hinge mechanism 10 (e.g., under elements 20, 22 and/or under plate portions 12*a*, 14*a*) to prevent fraying and delamination at the cut. According to another embodiment, ends of the climbing skin material S may be received by or within end caps (not shown) mounted to the ends of the ski members 102, 104, 106 arranged proximate the hinged joints. The skins S may also be permanently attached to the base or bottom surface of each ski member 102, 104, 106 by adhesive or fasteners thereby eliminating the need to peel and store the skins S The skins S may be formed from a nylon-based climbing skin material known in the art and configured to provide efficient glide and resist icing and glopping. The tip and tail of ski members 102, 106, respectively, may have P-TEX protectors (not shown) on the bottom thereof to prevent the skins from delaminating from the ski and, in use, to aid in breaking trail through unpacked snow.

Figure 8:
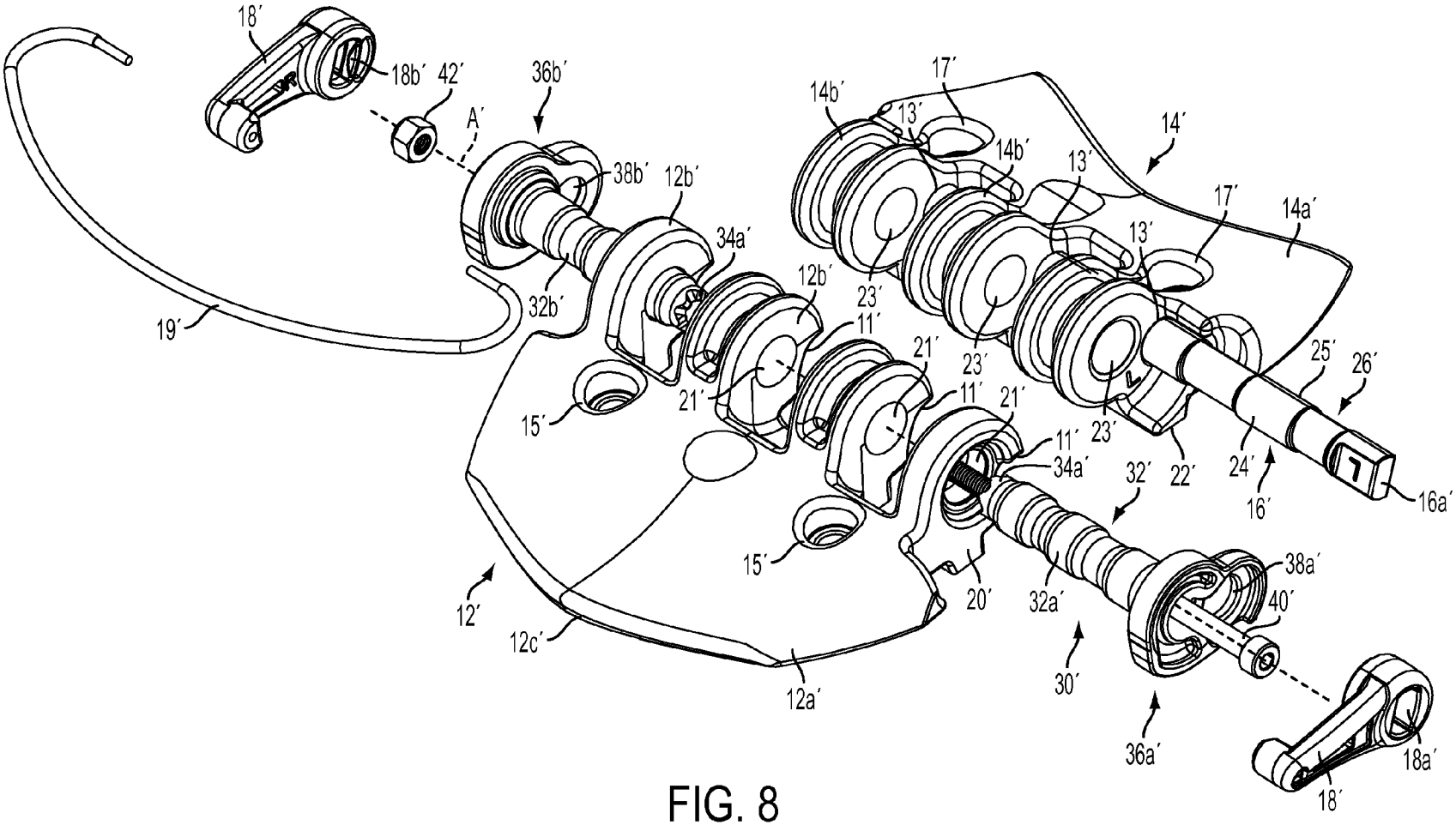
FIG. 8 depicts an exploded perspective view of a hinge mechanism (assembly) according to another embodiment.

FIG. 8 depicts an exploded perspective view of a hinge mechanism (assembly) 10' according to another embodiment. The hinge mechanism 10' may include a first hinge element 12', a second hinge element 14', and a locking element 16'. The first hinge element 12' may include a first plate portion 12*a*' having a front edge 12*c*'. The first hinge element 12' may include a first plurality of substantially parallel fingers 12*b*' spaced from one another. The second hinge element 14' may include a second plate portion 14*a*'. The second hinge element 14' may include a second plurality of substantially parallel fingers 14*b*' spaced from one another. The first and second pluralities of substantially parallel fingers 12*b*', 14*b*' may be arranged and configured to interlock with one another along a pivot axis A' such that the first and second hinge elements 12', 14' are rotatable relative to one another about the pivot axis A' between an open or extended position (see FIGS. 9 and 10) and a folded position (see FIGS. 11 and 12). The first and second plate portions 12*a*', 14*a*' may include through holes 15', 17', respectively, which holes are configured to receive fasteners for attaching the first and second hinge elements 12', 14' to respective parts of a foldable or collapsible device such as, for example, a collapsible ski.

The locking element 16' may be received within a though hole 13' extending through the second hinge element 14'. The locking element 16' may be configured to rotatably and releasably engage a receiving portion 11' in the first plurality of substantially parallel fingers 12*b*' when the first and second hinge elements 12', 14' are in the extended position to lock the first and second hinge elements 12', 14' relative to one another. The receiving portion 11' may include, for example, a curved recess on an outer circumferential portion of each of the fingers 12*b*' as shown in FIG. 8. One or more arms 18' may be coupled to the ends 16*a*' of the locking element 16' to allow a user to rotatably actuate the locking element 16' between a locked position and an unlocked position and vice versa so that the hinge elements 12', 14' can be respectively locked or pivoted relative to one another. Each arm 18' may include a hole 18*a*' for receiving the end 16*a*' of the locking element 16'. A cable element 19' may be attached to and extend between the ends of each arm 18' to allow a user to more easily grip and manipulate the locking element 16'. Additionally, the cable element 19' may have a predetermined length such that when the locking element 16' is in the locked position (see FIGS. 9-10) the cable element 19' may be received and secured by a feature on the fist hinge element 12' such as, for example, over the front edge 12*c*' of the first hinge element 12', to prevent the unintentional release of the locking element 16' during use. As with the locking element 16 according to the embodiment shown in FIG. 5, the locking element 16' may be a substantially cylindrical rod including a cam surface 24' configured to engage the receiving portion 11' (recess) in each finger 12*b*' and positively lock the first and second hinge elements 12', 14' relative to one another in the extended position when the locking element 16' is rotated to a locked position. The cam surface 24' of the locking element 16' may be defined on only a portion of the locking element 16', the remainder of the locking element 16' (e.g., on an opposite side thereof) having alternating guide surfaces 25' and gaps 26' arranged along the length thereof to allow passage of the fingers 12*b*' as the hinge elements 12', 14' are pivoted relative to one another when the locking element 16' is rotated to the unlocked position. The locking element 16' may be made of any suitable strong and lightweight material such as, for example but not limited to, die-cast 7075-T6, 6061-T6, or 2024-T6 hardened aluminum, anodized for added strength. One or more of the cam surface 24', guide surfaces 25', receiving portion surfaces 11' (on the first fingers 12*b*') and/or support surfaces (e.g., defined by the through hole 13' in the second hinge element 14' through which the locking element 16' extends) may be ramped or eccentric to provide positive locking upon rotation of the locking element 16' to the locked position.

The first and second pluralities of substantially parallel fingers 12*b*', 14*b*' each include respective through holes 21', 23' and downwardly extending members 20', 22'. When assembled such that the fingers 12*b*', 14*b*' are interlocked with one another, the through holes 21', 23' are aligned along pivot axis A'. A connector 30' may be disposed in and extend through the through holes 21', 23' to pivotably couple the first and second hinge elements 12', 14' to one another. The connector 30' may include a rod portion 32', which may be constructed in two pieces 32*a*', 32*b*' arranged to engage together at respective interlocking toothed ends 34*a*', 34*b*'. Alternatively, the rod portion 32' could also be constructed in one piece. The connector 30' may also include first and second end cap members 36*a*', 36*b*' at respective ends thereof. The end cap members 36*a*', 36*b*' may include holes 38*a*', 38*b*' arranged and configured to receive the locking element 16' and to be aligned with the locking element through hole 13' in the second hinge element 14'. The connector 30' may also include a fastener 40' such as, for example but not limited to, an elongated threaded bolt, which is receive in and extends though a center of the rod portion 30'. A nut 42' may be threadedly coupled to the threaded end of the fastener 40' to secure the first and second pieces 32*a*', 32*b*' together.

Figure 9:
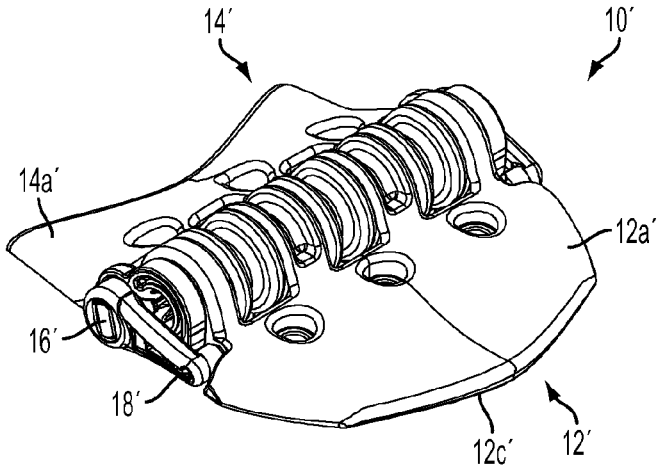
FIGS. 9 and 10 depict perspective and top views, respectively, of the hinge mechanism of FIG. 8 fully assembled and in an extended and locked position.
Figure 10A:
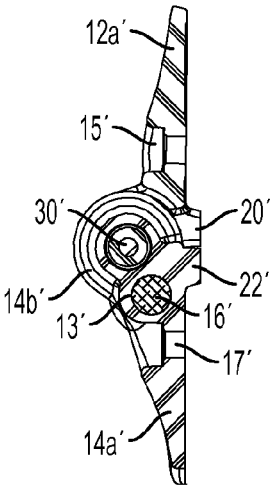
FIGS. 10A and 10B depict side cross-sectional views of the hinge mechanism 10' shown in FIG. 10 taken through lines 10A-10A and 10B-10B, respectively.
Figure 10:
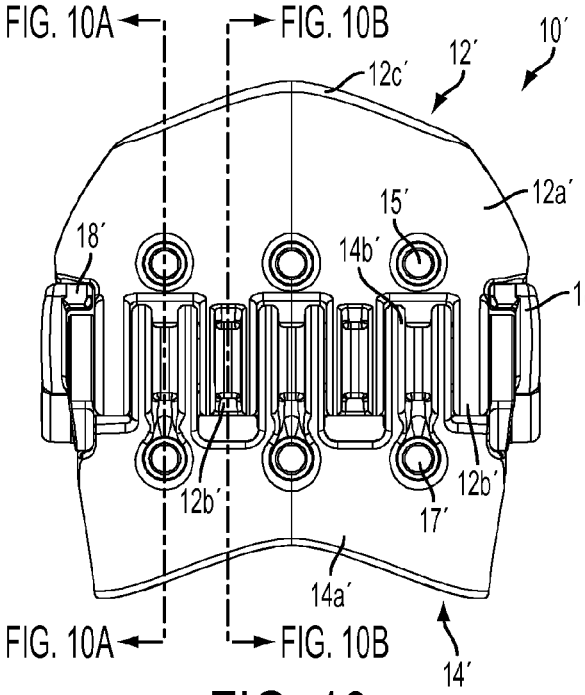
Figure 10B:
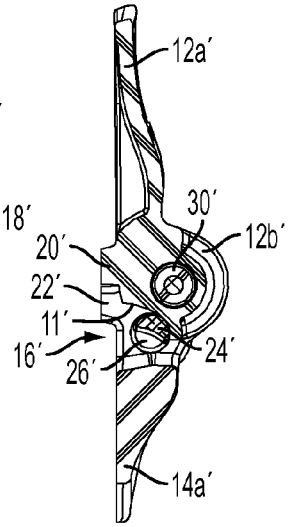
Figure 11:
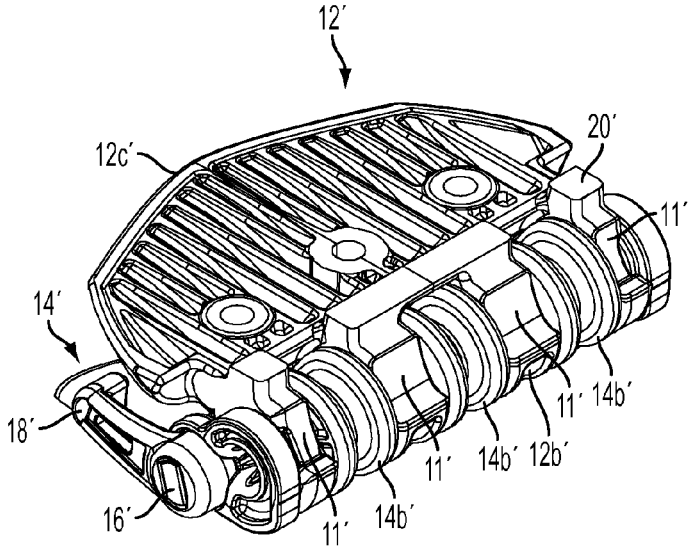
FIGS. 11 and 12 depict perspective and top views, respectively, of the hinge mechanism of FIG. 8 fully assembled and in an unlocked and folded position.
Figures 12, 12A, 12B:
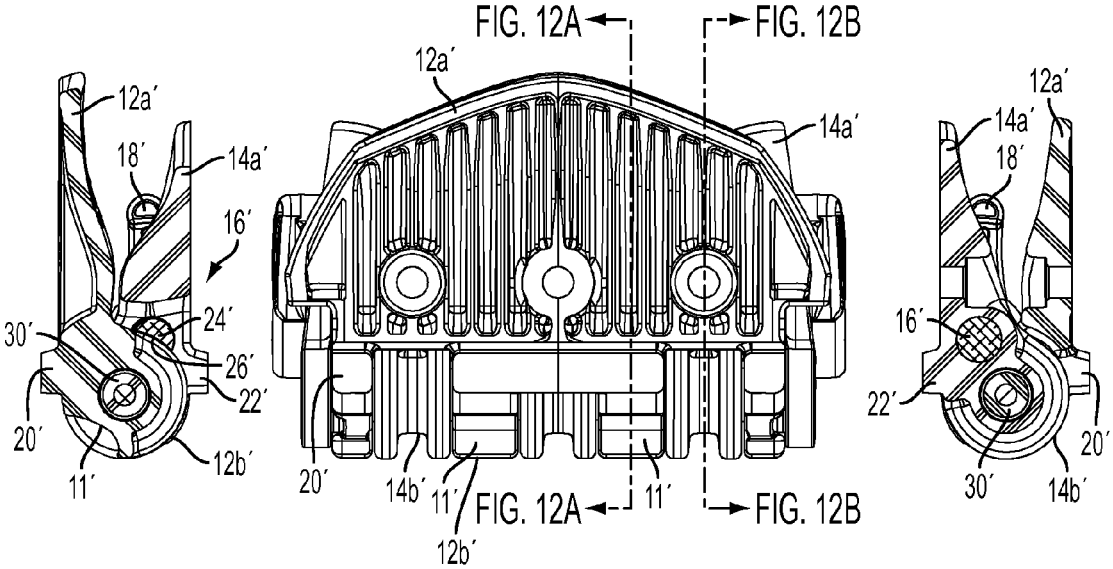
FIGS. 12A and 12B depict side cross-sectional views of the hinge mechanism 10' shown in FIG. 12 taken through lines 12A-12A and 12B-12B, respectively.

FIGS. 9 and 10 depict perspective and top views, respectively, of the hinge mechanism 10' of FIG. 8 fully assembled and in an extended and locked position. FIGS. 10A and 10B depict side cross-sectional views of the hinge mechanism 10' shown in FIG. 10 taken through lines 10A-10A and 10B-10B, respectively. As shown in FIG. 10B, when the locking element 16' is rotated to the locked position, the cam surface 24' of the locking element 16' positively engages the recess 11' on each finger 12*b*' of the first hinge element 12' to rotatably lock the hinge elements 12', 14' relative to one another. FIGS. 11 and 12 depict perspective and top views, respectively, of the hinge mechanism 10' of FIG. 8 fully assembled and in an unlocked and folded position. FIGS. 12A and 12B depict side cross-sectional views of the hinge mechanism 10' shown in FIG. 12 taken through lines 12A-12A and 12B-12B, respectively. As shown in FIG. 12A, when the locking element 16' is rotated to the unlocked position, the gaps 26' of the locking element 16' allow passage of the fingers 12*b*' of the first hinge element 12' as the hinge elements 12', 14' are rotated relative to one another about the connector 30'.

Figure 13:
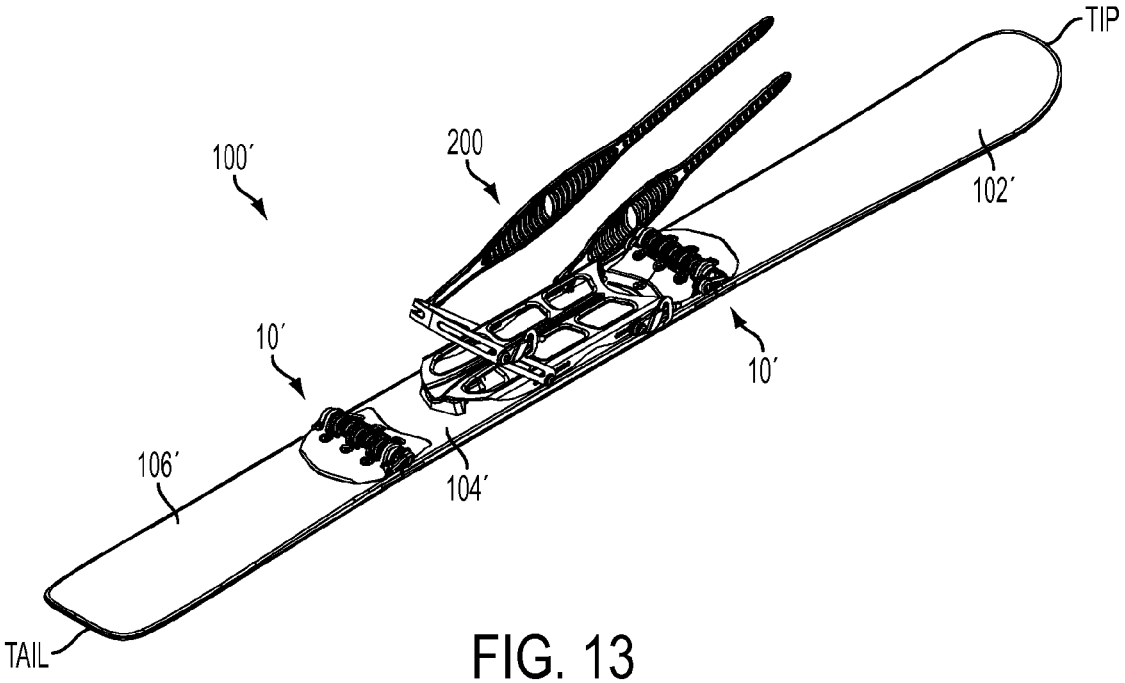
FIG. 13 is a perspective view of a collapsible ascension ski in an extended and locked configuration according to another embodiment of the invention.
Figure 14:
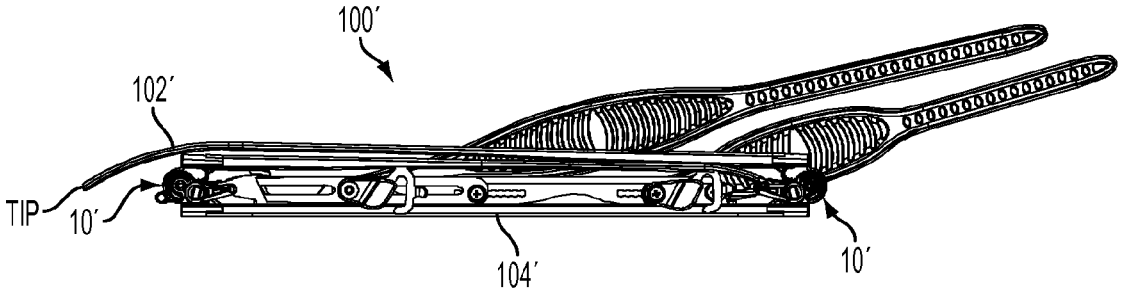
FIG. 14 is a perspective view of the collapsible ascension ski shown in FIG. 13 in an unlocked and folded configuration.

FIG. 13 is a perspective view of a collapsible ascension ski 100' in an extended and locked configuration according to another embodiment of the invention. The collapsible ski 100' may include first forward ski member 102', second middle ski member 104', and third rear ski member 106', each of which is pivotably coupled to the adjacent ski member by the locking hinge mechanisms 10' described above. The collapsible ski 100' is configured to be collapsed from the locked and extended position shown in FIG. 13 to a folded or collapsed position as shown in FIG. 14, whereby the ski 100' can be stowed, for example, in or on a backpack or the like. As shown in FIG. 13, the ski 100' may also include a boot binding device 200 coupled to the second ski member 104' according to an embodiment of the invention. The boot binding device 200 may be configured to receive and secure a boot of a user (e.g., a snowboarder) thereon and may be pivotably coupled to the second middle ski member 104'.

Figure 15:
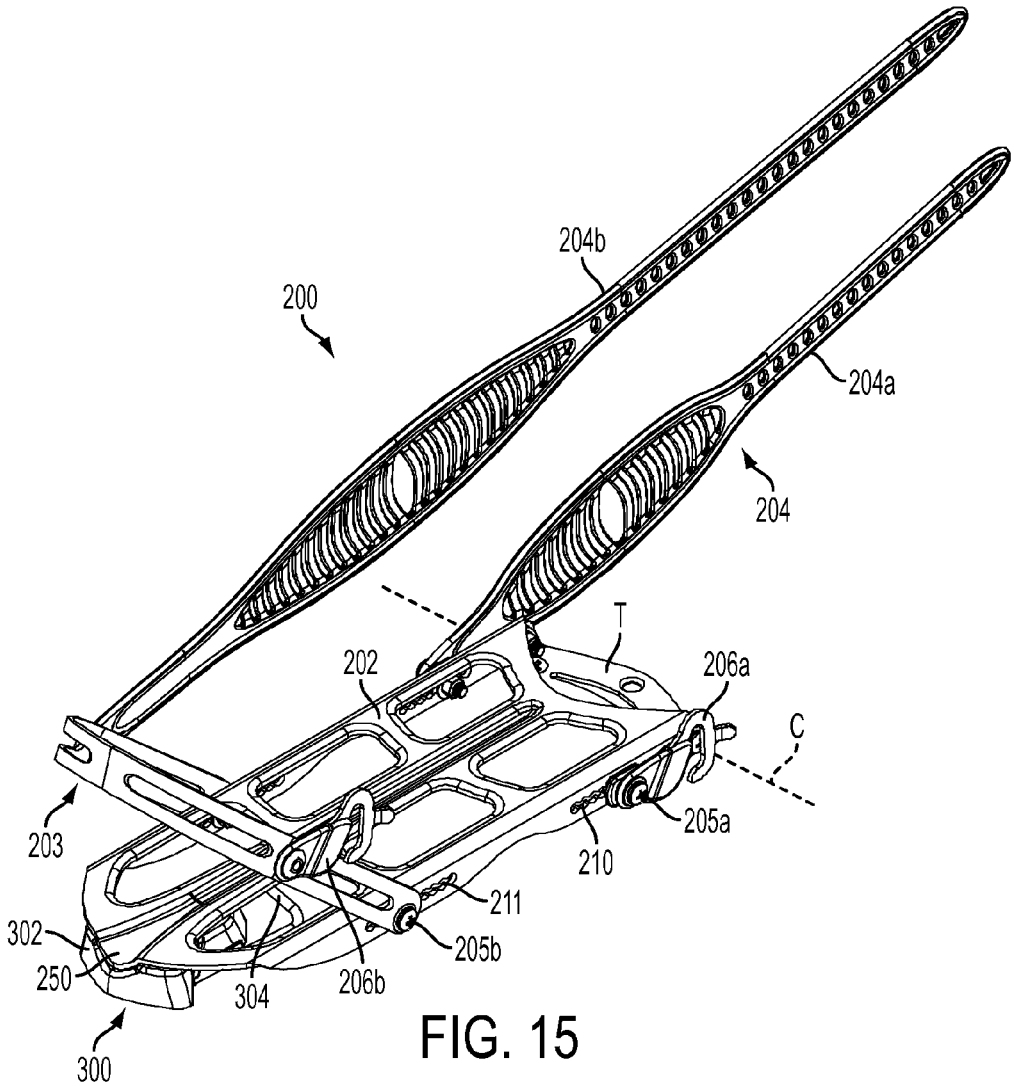
FIGS. 15 and 16 depict perspective and side views, respectively, of the boot binding device 200 according to an embodiment of the invention.
Figure 16:
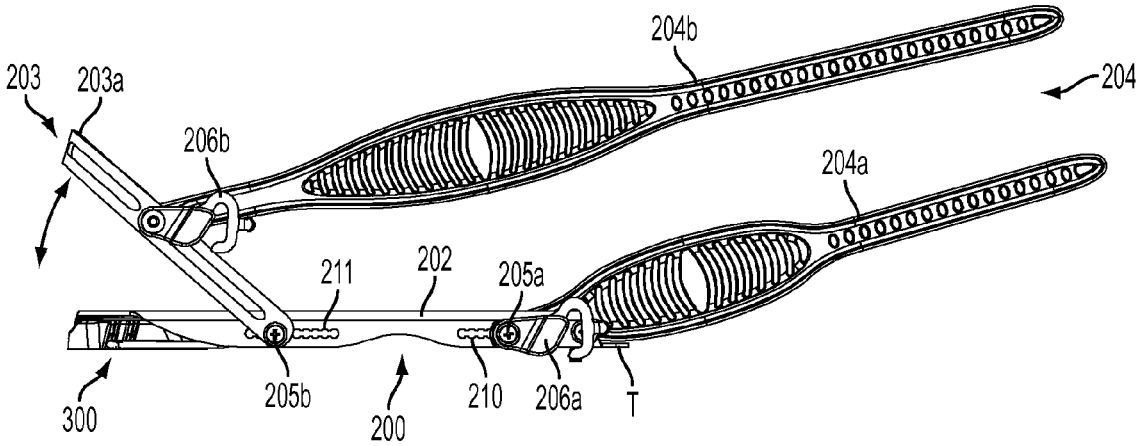

FIGS. 15 and 16 depict perspective and side views, respectively, of the boot binding device 200 according to an embodiment of the invention. As can be seen in FIGS. 15 and 16, for example, the boot binding 200 may include a support plate 202 pivotably coupled at a forward end thereof to a first mounting plate T which is configured to be rigidly fixed to a top surface of the second middle ski member 104' near the forward end thereof. The rear end of the support plate 202 is free (i.e., not attached to the ski member 104) to allow the binding 200 to freely rotate about a pivot axis C. A heel loop member 203 may be pivotably attached to the support plate 202 proximate the rear end thereof, for example, by fasteners 205*b*. The heel loop 203 may be, for example, substantially U-shaped, and may have a rear portion 203*a* shaped to receive the heel portion of a user's boot (not shown). The heel loop 203 may be pivotable between the raised (activated) position shown in FIGS. 15 and 16 and a lowered (collapsed) position in which the heel loop 203 extends substantially parallel to the support plate to allow the ski 100' to be folded or collapsed (see FIG. 14). A pair of flexible and durable straps 204 may be provided for securing a user's boot to the binding 200, which straps may be, for example, rubber, leather, a polymer material such as, for example, heavy duty polyurethane, or a combination. A toe strap 204*a* may be fixedly or pivotably attached to a side of the support plate 202 proximate the forward end thereof, for example, by fasteners 205*a*. A toe strap attachment buckle 206*a* configured to receive and secure an end of the toe strap 204*a* may be fixedly or pivotably attached to the opposite side of the support plate 202 proximate the forward end thereof, for example, by fasteners 205*a*. An ankle strap 204*b* may be fixedly or pivotably attached on a side of the heel loop 203, preferably on the same side as the attachment of the toe strap 204*a*. An ankle strap attachment buckle 206*b* may be fixedly or pivotably attached to the opposite side of the heel loop 203 and configured to receive and secure an end of the ankle strap 204*b*. The toe strap 204*a*, the toe strap buckle 206*a*, and the heel loop 203 may be longitudinally adjustable along the support plate 202. For example, the support plate 202 may include serrated slots 210, 211 arranged to receive fasteners 205*a*, 205*b*, respectively, and defining a plurality of longitudinal positions for the toe strap 204*a*, toe step buckle 206*a*, and heel loop 203 to allow customization by a user based on different sizes and styles of boot. Portions of one or more of the support plate 202 and the heel loop 203 may be removed for purposes of light weighting the binding 200 without sacrificing strength and rigidity.

The binding 200 may also include a heel elevator 300 including a base 302 and a wire member 304. The elevator base 302 may be fixedly secured to the top surface of the second middle ski member 104' of ski 100' near the rear portion of the support plate 202. The base 302 may include a longitudinal groove or protrusion in the top surface thereof to receive a complementary shaped protrusion or groove 250 defined on the bottom surface at the rear of the support plate 202. The support plate 202 may nest securely into the elevator base 302, increasing edge control of the ski 100' during use. The wire member 304 may be pivotably coupled to the base 302 and, during use, easily lifted and lowered with the handle or basket of a user's ski pole. When pivoted into a raised position, the wire member 304 may provide an elevated stop to support the rear of the support plate 202. This is useful when a user is ascending particularly steep terrain on skis 100'. The heel elevator base 302 may be made of, for example but not limited to, a durable Zytel®/rubber nylon to withstand continued abuse. The wire member 304 may be made from, for example but not limited to, a corrosion resistant galvanized steel.

In use, a user's boot (e.g., a snowboard boot) may be received on and secured to the binding 200. The sole of boot (not shown) contacts the top surface of support plate 202 with the boot toe positioned adjacent the forward end thereof (proximate mounting plate T) and the boot heel positioned adjacent the rear end thereof. Heel loop 203 is shown in FIGS. 15 and 16 in a raised position to receive the boot heel, and toe and ankle straps 204*a*, 204*b* are respectively secured over the toe and heel portions of the boot and releasably connected to the toe and ankle strap attachment buckles 206*a*, 206*b*, respectively. For alpine or cross-country touring, the user secures his/her boots to the bindings 200 on respective right and left skis 100', which are in the extended and locked position (see FIG. 13). As the user walks forward, the boot and binding 200 pivot together about the axis C at the forward end of the support plate 202 (see FIG. 15). A crampon (not shown) could also be releasably coupled to the support plate 202 if desired, depending on conditions.

Figure 17:
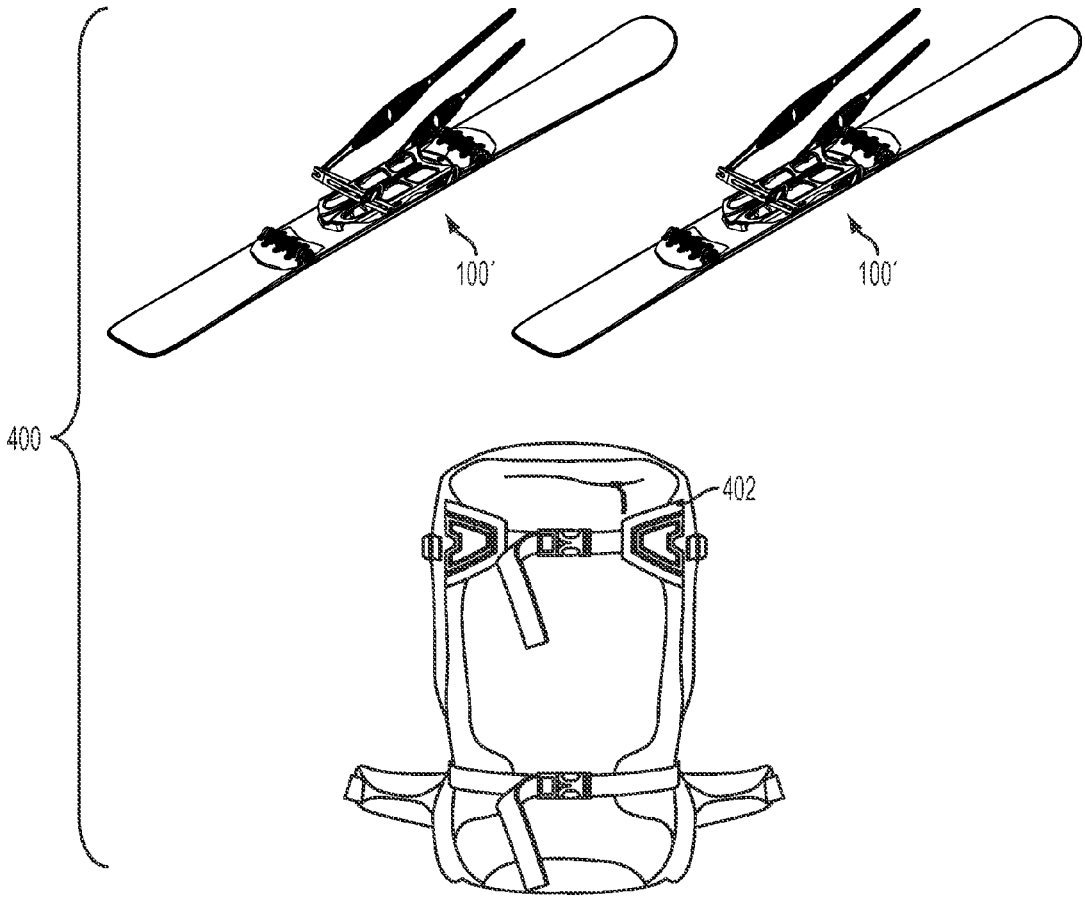
FIG. 17 depicts a kit for accessing and ascending snow-covered backcountry terrain according to an embodiment of the invention, the kit including a pair of collapsible ski devices and a backpack for receiving and stowing the ski devices.

FIG. 17 depicts a kit 400 for accessing and ascending snow-covered backcountry terrain according to an embodiment of the invention. The kit 400 may include a pair of the collapsible ski devices 100' as shown, for example, in FIGS. 13 and 14. The kit 400 may also include a backpack 402 configured to receive and stow the ski devices 100' when the ski devices 100' are in a collapsed configuration.

Figure 18:
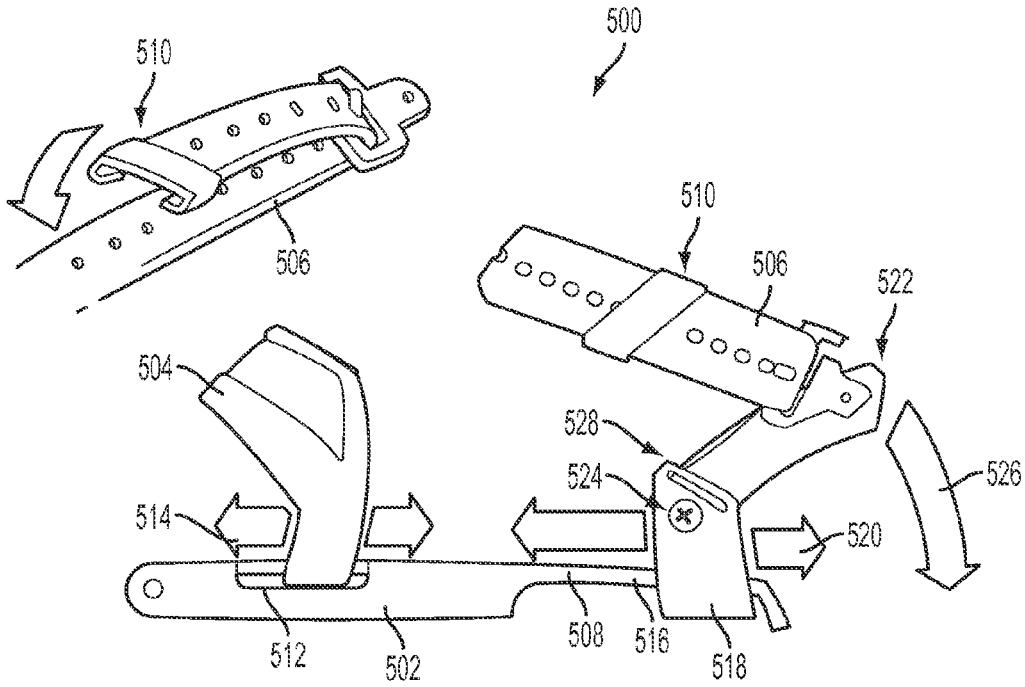
FIGS. 18 and 19 are schematic side views of boot binding devices according to still further embodiments of the invention.
Figure 19:
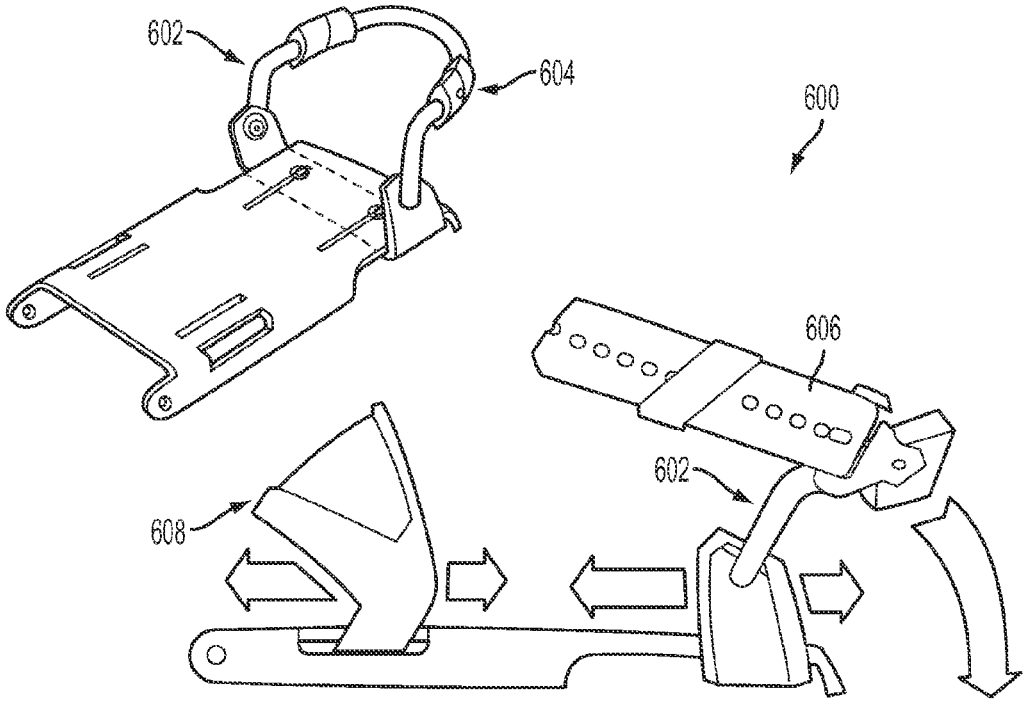

FIG. 18 is a schematic side view of a boot binding device 500 according to another embodiment of the invention and which is attachable to the skis 100 or 100' depicted in FIGS. 7 and 13. The binding may be configured to receive a boot of a snowboarder and may be pivotably coupled to the top surface of the second middle ski member 104 or 104' near the forward end thereof. The binding may include, for example, a support plate 502, toe and ankle straps 504, 506, and an adjustable height heel landing 508 for improved comfort touring on steep and flat terrain. The toe strap 504 can comprise rubber and mesh portions. The ankle strap 506 can include a molded on clip 510 that keeps straps together. The toe and ankle straps 504, 506 may be coupled to the support plate 502 and may be configured to receive and hold a user's boot. Some of the anchoring hardware could allow for translation along the longitudinal axis of the ski to aid in natural ski flex. For example, the toe strap 504 may be slidably coupled in a front slot 512 of the support plate 502 along axis 514. The support plate 502 may include a rear slot 516 configured to slidably receive a U-shaped element 518 along axis 520. The ankle strap 506 may be coupled to the U-shaped element 518 by a heel loop 522, made, for example, of stamped aluminum. The heel loop 522 may be pivotably coupled to the U-shaped element 518 by pivot 524, permitting pivoting of heel loop 522 along curve 526. Binding device 500 can also include a back-up slot 528. FIG. 19 is a schematic side view of a boot binding device 600 according to yet another embodiment of the invention. Boot binding device 600 can include a bent metal rod 602 for a heel loop, which can include a mounting point 604 for the ankle strap 606. Binding device 600 can include a toe strap 608 including rubber and mesh portions. When the boot binding configurations shown in FIGS. 18 and 19 are used with skis 100 or 100', the bindings may be entirely detached from the ski to allow the ski to be folded or collapsed for stowing, for example, in a user's backpack.

According to embodiments of the invention, advantageously, the aforementioned hinge mechanisms may enable a full-length ski to be collapsed for carrying in a backpack and provides ski-like sectional properties when deployed and locked out. A transition of the hinge element plate portions from relatively thin to thick at the plurality of interlocking figures may aid in transitioning flex while maintaining strength and durability. The hinges are fast and easy to use but also lock out positively, utilizing a low number of parts configured to carry the load efficiently through the structures.

According to other embodiments of the invention, the hinge mechanism described herein is not limited to use with the collapsible ski device and may be useful in combination with other folding products such as, for example but not limited to, folding furniture including folding tables (hinged legs), folding chairs, table leafs, folding ladders, folding bike frames, collapsible ski poles, folding shovels, etc. as will be readily apparent to those skilled in the art.

While various embodiments of the present invention have been described herein, it should be understood that they have been presented by way of example only, and not limitation. Thus, the breadth and scope of the present invention should not be limited by any of the described embodiments, but should instead be defined only in accordance with the following claims and their equivalents.

What is claimed is:

1. A hinge mechanism comprising:

a first hinge element including a first plate portion and a first plurality of substantially parallel fingers spaced from one another;

a second hinge element including a second plate portion and a second plurality of substantially parallel fingers spaced from one another, wherein the first and second pluralities of substantially parallel fingers interlock with one another along a pivot axis whereby the first and second hinge elements are rotatable relative to one another about the pivot axis between an extended position and a folded position; and a locking element extending substantially parallel to the pivot axis and configured to releasably engage a receiving portion in at least one of the first and second pluralities of substantially parallel fingers when the first and second hinge elements are in the extended position to lock the first and second hinge elements relative to one another;

wherein the locking element comprises a substantially cylindrical member positioned within a through hole of one of the first and second hinge elements, and wherein the locking element is rotatable between a locked position and an unlocked position;

wherein the locking element comprises a cam surface configured to engage the receiving portion in each finger of the other of the first and second pluralities of substantially parallel fingers when in the locked position to positively lock the first and second hinge elements relative to one another in the extended position; and wherein a first portion of the locking element includes the cam surface and a second portion of the locking element includes alternating guide surfaces and gaps, wherein when the locking element is in the unlocked position the gaps are configured to allow passage of each finger of the other of the first and second pluralities of substantially parallel fingers as the hinge elements are pivoted relative to one another to the folded position.

2. The hinge mechanism according to claim 1, wherein, when the first and second hinge elements are in the extended position and the locking element is engaged in the receiving portion of one of the first and second pluralities of substantially parallel fingers, the locking element is arranged to be loaded in shear in a plurality of cross-sections.

3. The hinge mechanism according to claim 1, wherein the receiving portion comprises a recess defined in each finger of one of the first and second pluralities of substantially parallel fingers and extending parallel to the pivot axis.

4. The hinge mechanism according to claim 1, wherein the first and second hinge elements include respective stop members configured to contact one another when the first and second hinge elements are in the extended position.

5. The hinge mechanism according to claim 4, wherein the stop elements comprise first and second plates arranged substantially perpendicular to the first and second plate portions, respectively.

6. The hinge mechanism according to claim 1, wherein, when the first and second hinge elements are locked in the extended position, respective bottom surfaces of the first and second plate portions define a faceted camber.

7. The hinge mechanism according claim 6, wherein an angle between the bottom surfaces of the first and second plate portions is less than 180 degrees.

8. The hinge mechanism according to claim 1, further comprising an arm coupled to the locking element and configured to allow a user to rotate the locking element between a locked position and an unlocked position.

9. A collapsible ski device, comprising:

a first forward ski member having a tip and a rear end;

a second middle ski member having a forward end and a rear end; and a third rear ski member having a forward end and a tail, wherein the forward end of the second middle ski member is pivotably coupled to the rear end of the first forward ski member by a first hinge mechanism, wherein the rear end of the second middle ski member is pivotably coupled to the forward end of the third rear ski member by a second hinge mechanism, and wherein the first and second hinge mechanisms comprise the hinge mechanism according to claim 1.

10. The collapsible ski device according to claim 9, wherein the ski device is configured to be collapsed from a locked and extended position to a folded position whereby the ski device is stowable in or on a backpack.

11. The collapsible ski device according to claim 10, further comprising a strip of climbing skin material secured to a bottom surface of each of the first forward ski member, the second middle ski member, and the third rear ski member.

12. The collapsible ski device according to claim 11, wherein at least one end of the climbing skin material is wrapped around an end of the ski member and secured between a portion of the hinge mechanism and a surface of the ski member.

13. The collapsible ski device according to claim 11, wherein the bottom surfaces of the adjacent ski members define a faceted camber.

14. The collapsible ski device according claim 13, wherein an angle between the bottom surfaces of adjacent ski members is less than 180 degrees.

15. The collapsible ski device according to claim 9, wherein the first and second plate portions of the first and second hinge elements are secured to respective top surfaces of adjacent ski members.

16. The collapsible ski device according to claim 9, further comprising a boot binding, wherein the boot binding comprises:

a support plate pivotably coupled to a top surface of the second middle ski member proximate the forward end thereof;

a toe strap coupled to the support plate and configured to be secured over a toe portion of a user's boot;

a heel loop pivotably coupled to the support plate; and an ankle strap coupled to the heel loop and configured to be secured over an ankle portion of the user's boot.

17. The collapsible ski device according to claim 16, further comprising a U-shaped mounting plate secured to the top surface of the second middle ski member proximate the forward end thereof, wherein the support plate is pivotably coupled to the mounting plate.

18. The collapsible ski device according to claim 16, wherein one or both of the heel loop and the toe strap are longitudinally adjustable along the support plate.

19. The collapsible ski device according to claim 16, wherein the heel loop is pivotable relative to the support plate between a collapsed position and an activated position, the heel loop extending substantially parallel to the support plate and the second middle ski member when in the collapsed position.

20. The collapsible ski device according to claim 16, further comprising a heel elevator device fixedly secured to the top surface of the second middle ski member proximate the rear end thereof and configured to engage and support the support plate, wherein the heel elevator device comprises a base member and a wire element.

21. The collapsible ski device according to claim 20, wherein the base member of the heel elevator device comprises a longitudinal groove or protrusion arranged to receive a longitudinal protrusion or groove on a bottom of the support plate to provide lateral support during use of the ski device over flat or slightly inclined terrain.

22. The collapsible ski device according to claim 21, wherein the wire element is pivotably coupled to the base member and is rotatable between a first position, in which the wire element is substantially parallel to the top surface of the second middle ski member, and a second position, in which the wire element is at an angle to the top surface to receive and support the support plate during use of the ski device on steep climbs.

23. A kit for accessing and ascending snow-covered backcountry terrain, comprising a pair of the collapsible ski devices of claim 9.

24. The kit according to claim 23, further comprising a backpack configured to receive and stow the ski devices when the ski devices are in a collapsed configuration.

25. The kit according to claim 23, further comprising a boot binding on each collapsible ski device, wherein the boot binding comprises:

a support plate pivotably coupled to the top surface of the second middle ski member proximate the forward end thereof;

a toe strap coupled to the support plate and configured to be secured over a toe portion of a user's boot;

a heel loop pivotably coupled to the support plate; and an ankle strap coupled to the heel loop and configured to be secured over an ankle portion of the user's boot.

26. The kit according to claim 25, wherein the heel loop is pivotable relative to the support plate between a collapsed position and an activated position, the heel loop arranged substantially parallel to the support plate and the second middle ski member when in the collapsed position.

27. A hinge mechanism comprising:

a first hinge element including a first plate portion and a first plurality of substantially parallel fingers spaced from one another;

a second hinge element including a second plate portion and a second plurality of substantially parallel fingers spaced from one another, wherein the first and second pluralities of substantially parallel fingers interlock with one another along a pivot axis whereby the first and second hinge elements are rotatable relative to one another about the pivot axis between an extended position and a folded position;

a locking element extending substantially parallel to the pivot axis and configured to releasably engage a receiving portion in at least one of the first and second pluralities of substantially parallel fingers when the first and second hinge elements are in the extended position to lock the first and second hinge elements relative to one another;

an arm coupled to the locking element, the arm pivotable with respect to the first plate portion and the second plate portion, wherein the arm is configured to allow a user to rotate the locking element between a locked position and an unlocked position; and a safety lock element on the arm arranged to be removably attached to a portion of one of the first and second hinge elements when the locking element is in the locked position to prevent the unintentional release of the locking element.

28. The hinge mechanism according to 27, wherein the safety lock element comprises a cable connected to the arm and configured to be received over an edge of one of the first and second hinge elements when the locking element is in the locked position.

29. A method for making a collapsible ski device, comprising:

providing a first forward ski member, a second middle ski member, and a third rear ski member;

permanently attaching a strip of climbing skin material to a bottom surface of each of the ski members;

pivotably coupling an end of the first forward ski member to an end of the second middle ski member by a first hinge mechanism;

pivotably coupling another end of the second middle ski member to an end of the third rear ski member by a second hinge mechanism, wherein each of the first and second hinge mechanisms comprise:

a first hinge element including a first plate portion and a first plurality of substantially parallel fingers spaced from one another;

a second hinge element including a second plate portion and a second plurality of substantially parallel fingers spaced from one another, wherein the first and second pluralities of substantially parallel fingers interlock with one another along a pivot axis whereby the first and second hinge elements are rotatable relative to one another about the pivot axis between an extended position and a folded position; and a locking element extending substantially parallel to the pivot axis and configured to releasably engage a receiving portion in at least one of the first and second pluralities of substantially parallel fingers when the first and second hinge elements are in the extended position to lock the first and second hinge elements relative to one another;

an arm coupled to the locking element, the arm pivotable with respect to the first plate portion and the second plate portion, wherein the arm is configured to allow a user to rotate the locking element between a locked position and an unlocked position; and a safety lock element on the arm arranged to be removably attached to a portion of one of the first and second hinge elements when the locking element is in the locked position to prevent the unintentional release of the locking element; and pivotably attaching a boot binding device to a top surface of the second middle ski member.

30. The method according to claim 29, wherein the step of permanently attaching comprising wrapping at least one end of the strip of climbing skin material around an end of the ski member securing the end between a portion of the hinge mechanism and a surface of the ski member.

31. The method according to claim 29, wherein pivotally attaching a boot binding device to a top surface of the second middle ski member comprises attaching a boot binding device comprising:

a support plate pivotably coupled to the top surface of the second middle ski member;

a toe strap coupled to the support plate and configured to be secured over a toe portion of a user's boot;

a heel loop pivotably coupled to the support plate; and an ankle strap coupled to the heel loop and configured to be secured over an ankle portion of the user's boot.

* * * * *